US009713386B2

(12) United States Patent
Pawlikoski

(10) Patent No.: US 9,713,386 B2
(45) Date of Patent: Jul. 25, 2017

(54) SUN SHADE AND CHAIR ASSEMBLY

(71) Applicant: Michael Pawlikoski, Carmichaels, PA (US)

(72) Inventor: Michael Pawlikoski, Carmichaels, PA (US)

( * ) Notice: Subject to any disclaimer, the term of this patent is extended or adjusted under 35 U.S.C. 154(b) by 120 days.

(21) Appl. No.: 14/693,131

(22) Filed: Apr. 22, 2015

(65) Prior Publication Data

US 2016/0309898 A1 Oct. 27, 2016

(51) Int. Cl.
*A47C 1/14* (2006.01)
*A47C 7/62* (2006.01)
*A47C 7/66* (2006.01)

(52) U.S. Cl.
CPC ..... *A47C 7/66* (2013.01); *A47C 1/143* (2013.01)

(58) Field of Classification Search
CPC ..... A47C 1/14; A47C 1/143; A47C 1/146; A47C 7/66; A47C 7/70; E04H 15/58
See application file for complete search history.

(56) References Cited

U.S. PATENT DOCUMENTS 3,738,703 A 6/1973 Kunimatu
4,030,748 A * 6/1977 Brock ..... A47C 7/66 135/96
4,635,667 A 1/1987 Harn
4,809,724 A * 3/1989 Fuser ..... A45B 11/00 135/16
4,911,498 A * 3/1990 Becher ..... A47C 7/66 297/184.12
5,013,085 A 5/1991 Craig
5,203,363 A * 4/1993 Kidwell ..... A47C 7/66 135/90
5,320,405 A 6/1994 Foster et al.
5,441,067 A 8/1995 James et al.
5,833,310 A 11/1998 Labelle
6,050,280 A * 4/2000 Jeske ..... E04H 15/58 135/115
6,789,557 B1 9/2004 Wahl, Jr.
7,175,231 B2 * 2/2007 Gallo ..... A47C 7/38 297/218.1
D545,580 S 7/2007 Marin
7,740,310 B1 * 6/2010 Forster ..... A47C 7/66 135/96
7,832,804 B2 * 11/2010 LaFreniere ..... A47C 1/03 297/31
8,991,410 B2 * 3/2015 Surek ..... E04H 15/02 135/117

(Continued)

*Primary Examiner* — David R Dunn
*Assistant Examiner* — Tania Abraham

(57) ABSTRACT

A sun shade assembly includes a sun bathing chair including an upper section with an upper surface to support a person's head. Each of a pair of supports has a bottom end and an upper end. The supports are vertically oriented and each bottom end has a base attached thereto to retain the supports in a vertical orientation. A pair of mounts is provided and each of the supports has one of the mounts positioned thereon. The mounts are movable between associated ones of the upper and lower ends. The mounts are releasably secured to an associated one of the supports to retain the mounts at a selected position on the supports. An elongated rod extends between and is mounted on the mounts. The rod is positioned over the upper surface to block sun over a portion of the sun bathing chair.

8 Claims, 7 Drawing Sheets

(56) References Cited

U.S. PATENT DOCUMENTS

| | | | | |
|---|---|---|---|---|
| 2005/0116514 | A1* | 6/2005 | Bufkin | A47C 7/70<br>297/161 |
| 2006/0054207 | A1* | 3/2006 | Wootliff | A47C 29/003<br>135/96 |
| 2007/0034342 | A1* | 2/2007 | Fill | A45B 11/00<br>160/351 |
| 2012/0086245 | A1* | 4/2012 | Nelson | A47C 7/70<br>297/188.18 |
| 2015/0282627 | A1* | 10/2015 | Gjelaj | F21S 9/037<br>362/183 |

* cited by examiner

SUN SHADE AND CHAIR ASSEMBLY

BACKGROUND OF THE DISCLOSURE

Field of the Disclosure

The disclosure relates to shading devices and more particularly pertains to a new shading device for blocking sunlight from striking a person's eyes as they sunbathe.

SUMMARY OF THE DISCLOSURE

An embodiment of the disclosure meets the needs presented above by generally comprising a sun bathing chair including an upper section pivotally coupled to a lower section. The upper section is configured to support a person's upper torso and head. The sun bathing chair has an upper surface, a first lateral edge and a second lateral edge. Each of a pair of supports has a bottom end and an upper end. The supports are vertically oriented and each bottom end has a mount attached thereto to retain the supports in a vertical orientation. A pair of mounts is provided and each of the supports has one of the mounts positioned thereon. The mounts are movable between associated ones of the upper and lower ends. The mounts are releasably secured to an associated one of the supports to retain the mounts at a selected position on the supports. An elongated rod extends between and is mounted on the mounts. The rod is positioned over the upper surface to block sun over a portion of the sun bathing chair.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
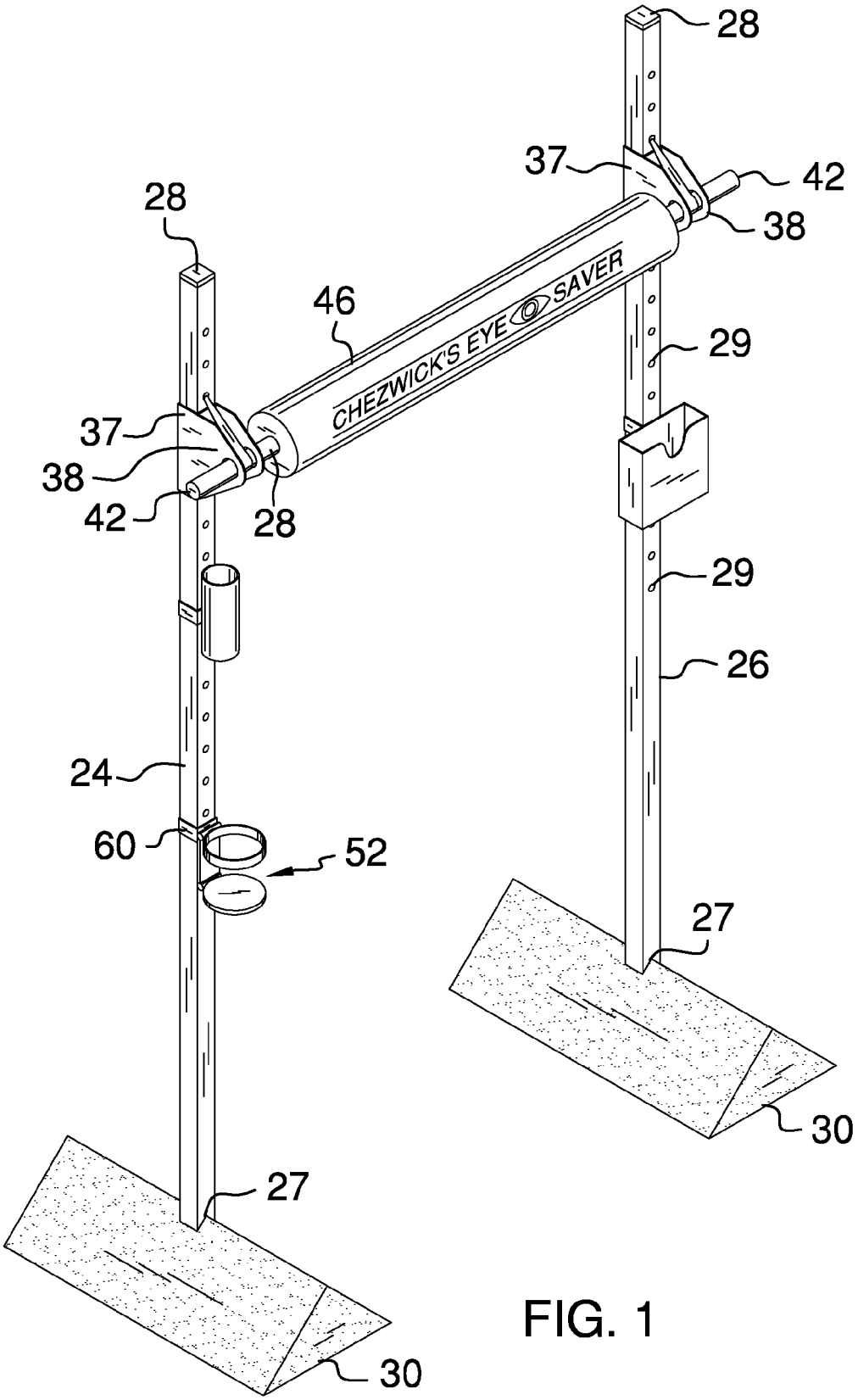
FIG. 1 is a front perspective view of a sun shade assembly according to an embodiment of the disclosure.
Figure 3:
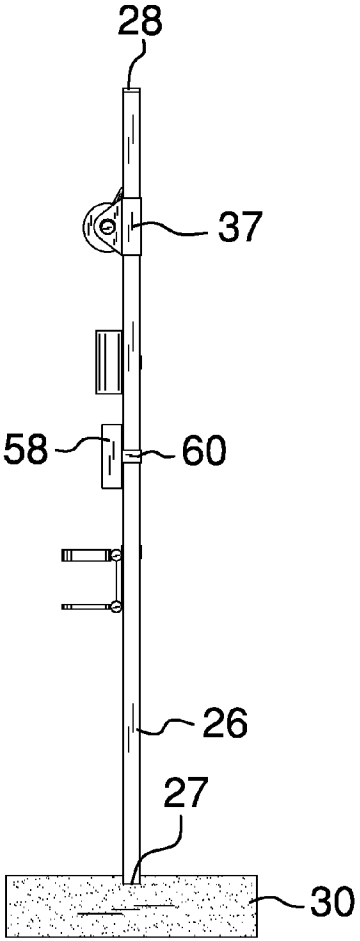
FIG. 3 is a side view of an embodiment of the disclosure.
Figure 2:
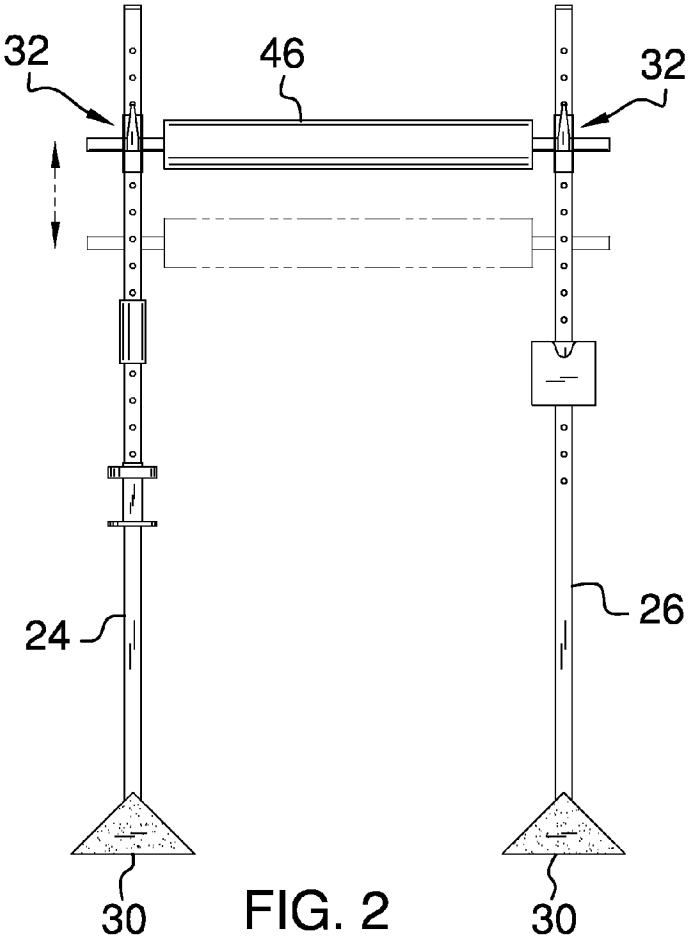
FIG. 2 is a front view of an embodiment of the disclosure.

With reference now to the drawings, and in particular to FIGS. 1 through 8 thereof, a new shading device embodying the principles and concepts of an embodiment of the disclosure and generally designated by the reference numeral 10 will be described.

As best illustrated in FIGS. 1 through 8, the sun shade assembly 10 generally comprises a conventional sun bathing chair 12 that includes an upper section 14 pivotally coupled to a lower section 16. The upper section 14 is configured to support a person's upper torso and head. The sun bathing chair 12 has an upper surface 18, a first lateral edge 20 and a second lateral edge 22.

A pair of supports 24, 26 is provided and each of the supports 24, 26 has a bottom end 27 and an upper end 28. The supports 24, 26 are vertically oriented. The supports 24, 26 may have a plurality of apertures 29 extending therein for reasons stated below. A pair of bases 30 is also provided and each of the bottom ends 27 has one of the bases 30 attached thereto. The bases 30 retain the supports 24, 26 in a vertical orientation. Each of the bases 30 may be comprised of a resiliently compressible material such as an elastomer.

Figure 5:
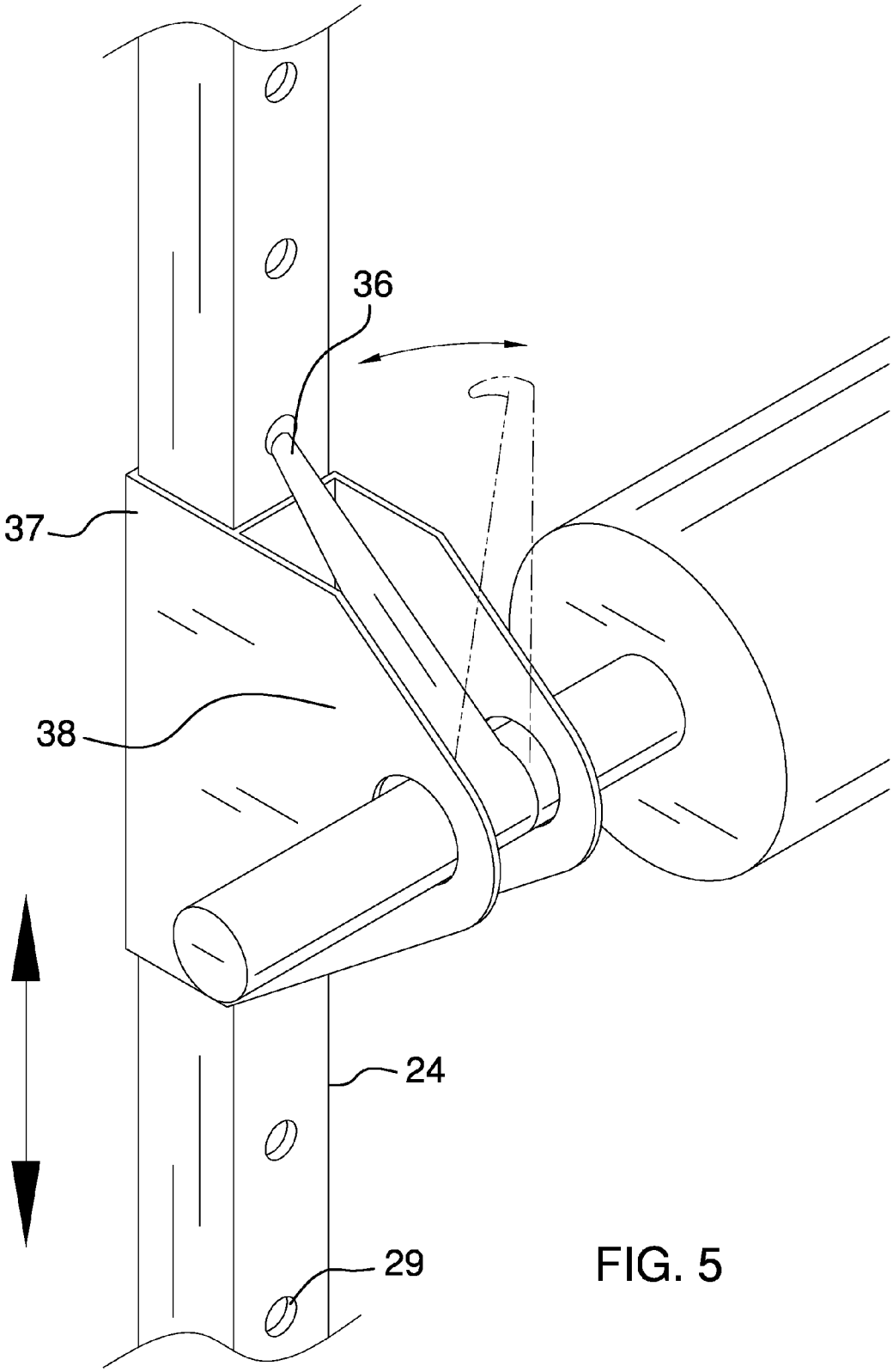
FIG. 5 is a broken perspective view of a mount of an embodiment of the disclosure.

A pair of mounts 32 is provided. Each of the supports 24, 26 as one of the mounts 32 positioned thereon. The mounts 32 are movable between associated ones of the upper 28 and lower 27 ends. Each of the mounts 32 is releasably securable to an associated one of the supports 24, 26 to secure the mounts 32 at a selected position on the supports 24, 26. The mounts 32 may include removable pegs 34 or a latch 36 that are extendable into one of the apertures 29 to retain the mounts 32 where selected. Each of the mounts 32 includes a sleeve 37 that are slidably positioned on one of the supports 24, 26 such that each support extends through one of the sleeves. A saddle 38 is attached to the sleeve 37 as shown in FIG. 5.

Figure 6:
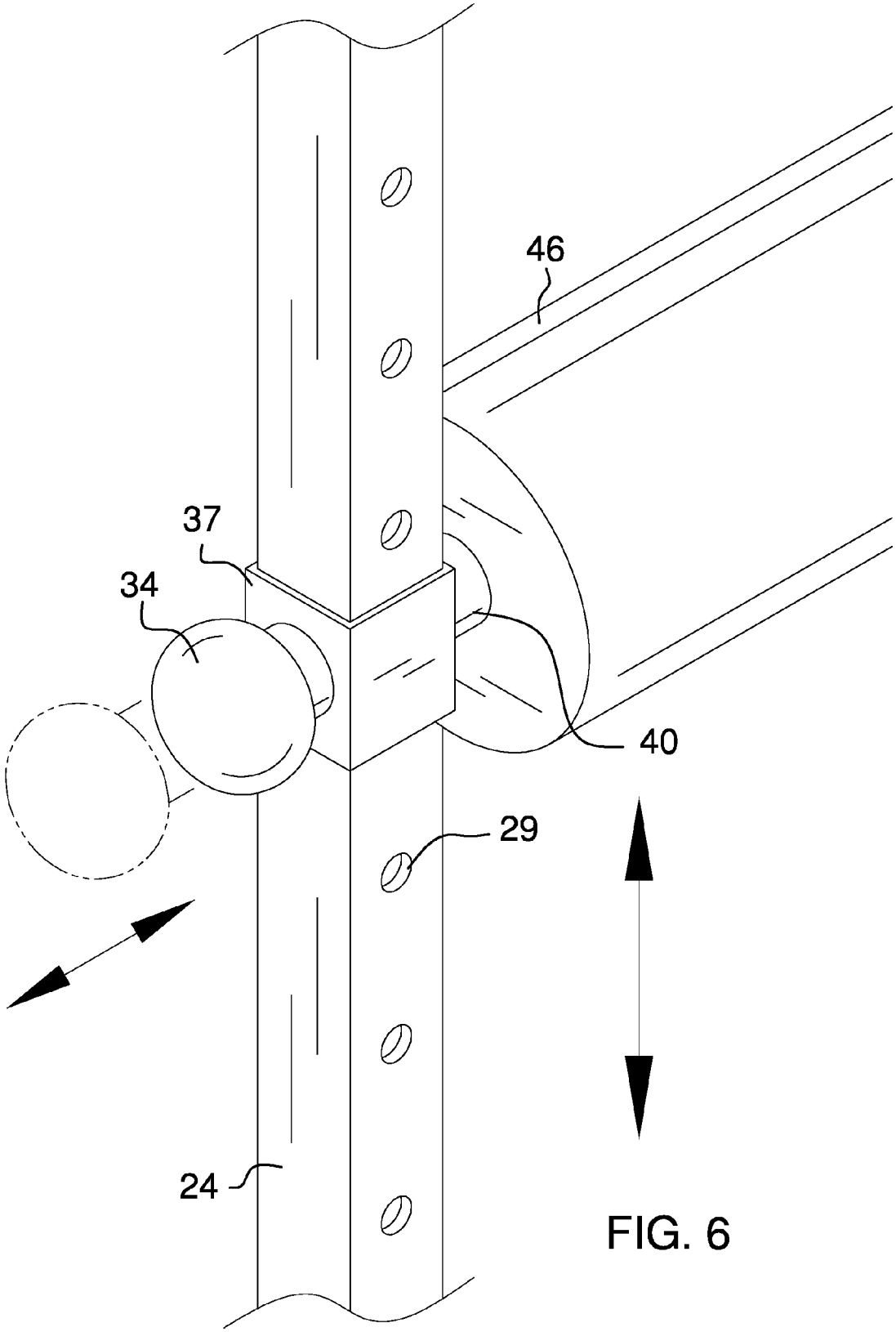
FIG. 6 is a broken perspective view of a mount of an embodiment of the disclosure.
Figure 7:
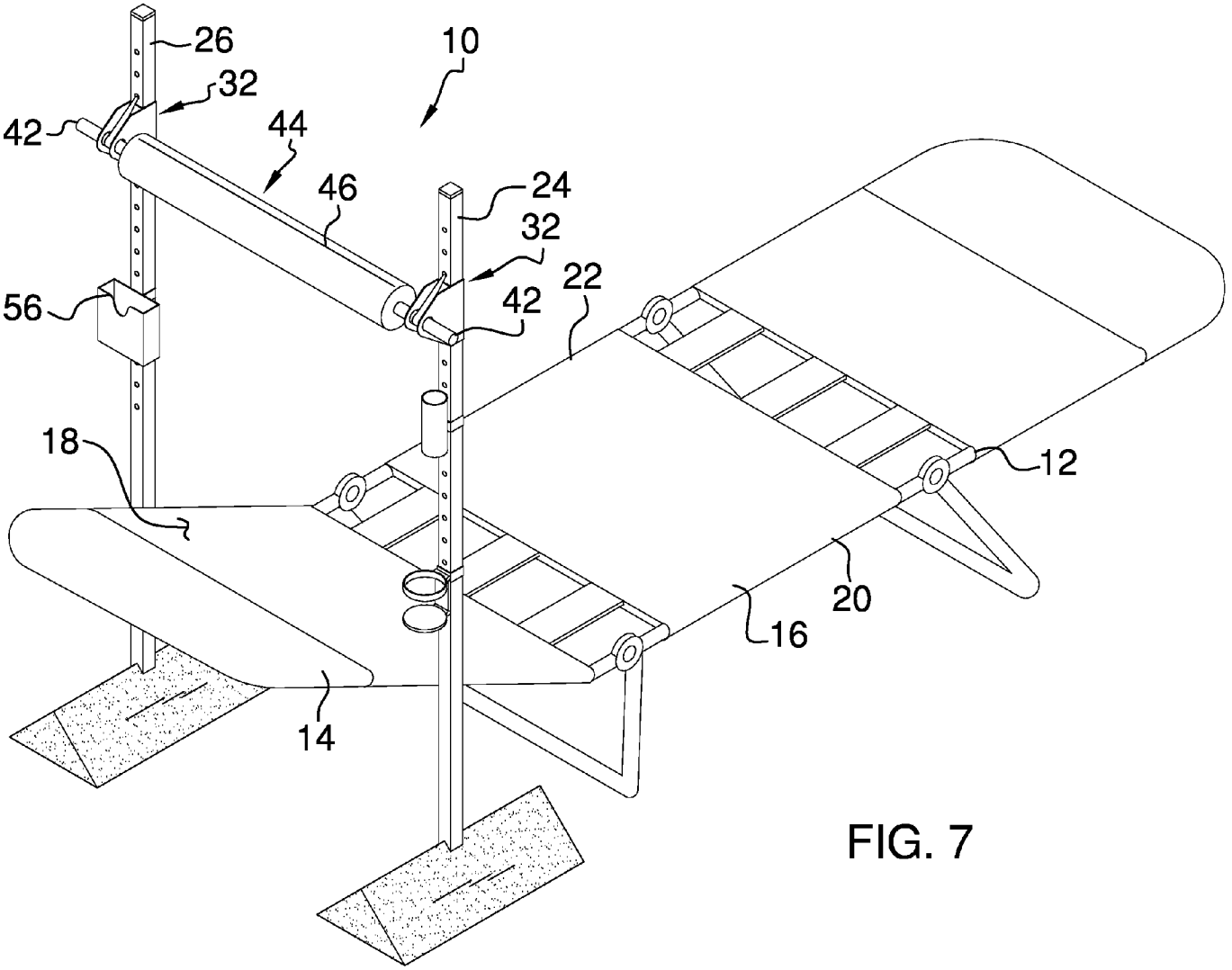
FIG. 7 is a perspective in-use view of an embodiment of the disclosure.

An elongated rod 40 extends between and is mounted on the mounts 32. Alternatively, as shown in FIG. 6, the rod 40 may be attached directly to the sleeve 37 of the mount 32. The rod 40 is positioned over the upper surface 18 to block sun over a portion of the sun bathing chair 12. The rod 40 has a pair of terminal ends 42 each extending through the saddle 38 on an associated one of the mounts 32. A central portion 44 of the rod 40 is defined extending between the mounts. The central portion 40 may have a covering 46 positioned thereon that may comprise a resiliently compressible material and further may have a cylindrical shape. A diameter of the covering 46 is less than 6.0 inches.

Figure 4:
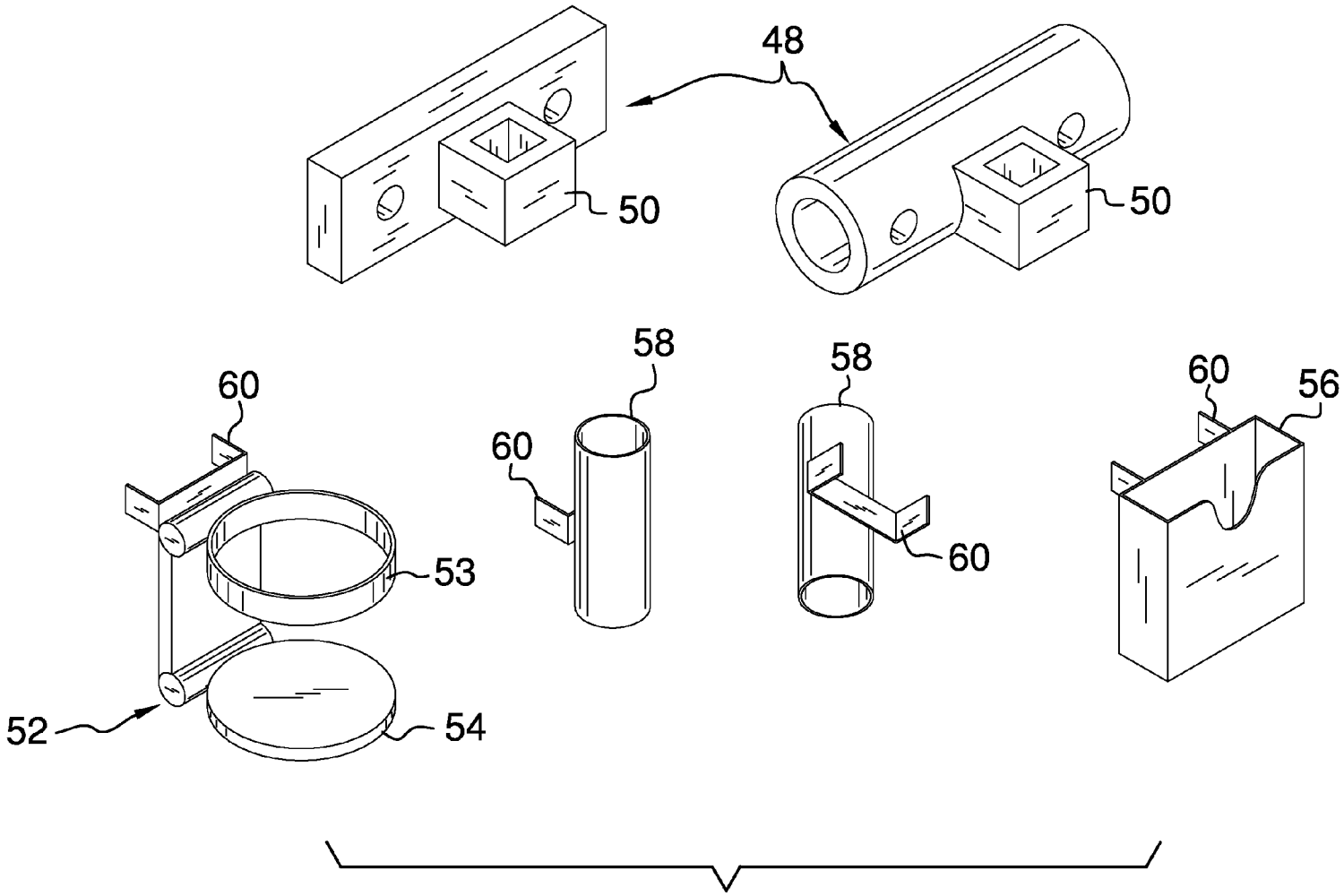
FIG. 4 is a perspective view of a plurality of attachments of an embodiment of the disclosure.
Figure 8:
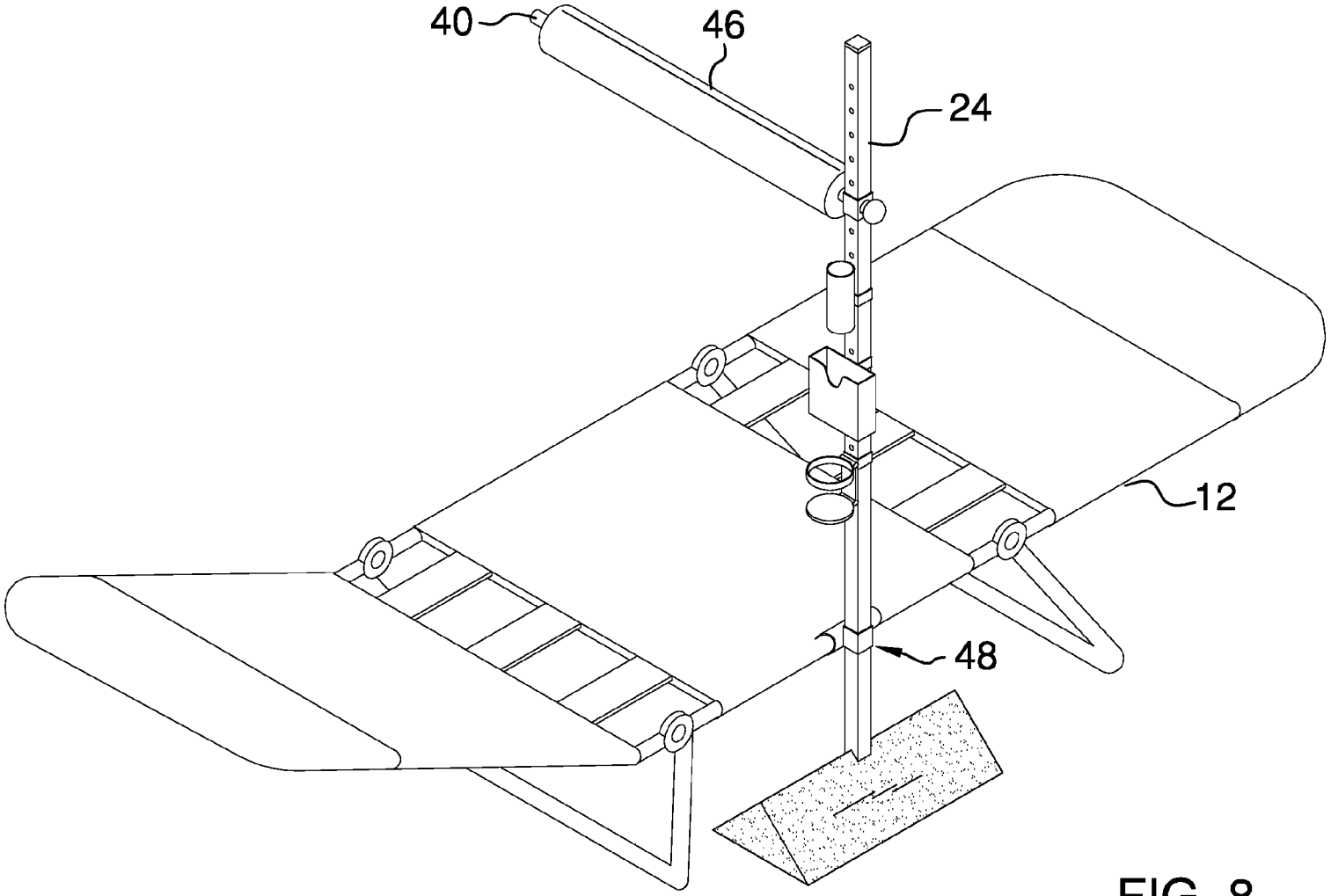
FIG. 8 is a perspective view of an embodiment of the disclosure.

In an embodiment shown in FIG. 8, the supports 24, 26 may be engaged with brackets 48 that are attached directly to the sun bathing chair 12. A single support 24, as shown, may be utilized with this embodiment. FIG. 4 depicts a pair of different sun bathing chair brackets 48 having support receivers 50 attached thereto.

Attachments may be provided that are securable to the supports 24, 26. For example, a cup holder 52 is removably attachable to one of the supports 24, 26 and includes a ring 53 and a plate 54 for supporting a beverage container. A housing 56 may also be removably attached to one of the supports 24, 26. for holding any number of items but in particular cellular phones and the like. A cylinder 58 may be provided which is particularly useful for receiving sunglasses. Each of the housing 56, cylinder 58, and cup holder 52 may include a coupler 60 for frictionally engaging one of the supports 24, 26.

In use, the supports 24, 26 are positioned on either side of the sun bathing chair 12 such that the rod 40 is positioned over the sun bathing chair 12. The mounts 32 are positioned such that rod 40 is located to block sunlight from falling on a user's eyes. As the sun moves the mounts 32 may be raised or lowered as needed to retain a shadow formed by the rod 40 on the eyes of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sun shade and chair assembly configured to prevent sun from striking a person's eyes, said system including:

a sun bathing chair including an upper section pivotally coupled to a lower section, said upper section being configured to support a person's upper torso and head, said sun bathing chair having an upper surface, a first lateral edge and a second lateral edge;

a pair of supports, each of said supports having a bottom end and an upper end, said supports being vertically oriented;

a pair of mounts, each of said supports having one of said mounts positioned thereon, said mounts being movable between associated ones of said upper and lower ends, each of said mounts being releasably securable to an associated one of said supports to secure said mounts at a selected position on said supports, wherein each of said mounts includes a sleeve slidably positioned on one of said supports such that said support extends through said sleeve, and a saddle being attached to said sleeve; and an elongated rod extending between and being mounted on said mounts, said rod being positioned over said upper surface to block sun over a portion of said sun bathing chair;

said rod having a pair of terminal ends each extending through said saddle on an associated one of said mounts.

2. The sun shade and chair assembly according to claim 1, further including a pair of bases, each of said bottom ends having one of said bases attached thereto, said bases retaining said supports in a vertical orientation.

3. The sun shade and chair assembly according to claim 2, wherein each of said bases being comprised of a resiliently compressible material.

4. The sun shade and chair assembly according to claim 1, further including a central portion of said rod being defined extending between said mounts, said central portion having a covering positioned thereon, said covering comprising a resiliently compressible material.

5. The sun shade and chair assembly according to claim 4, wherein an outer surface of said covering has a greatest diameter being less than 6.0 inches.

6. The sun shade and chair assembly according to claim 1, further including a cup holder being removably attached to one of said supports.

7. The sun shade and chair assembly according to claim 1, further including a housing being removably attached to one of said supports.

8. A sun shade and chair assembly configured to prevent sun from striking a person's eyes, said system including:

a sun bathing chair including an upper section pivotally coupled to a lower section, said upper section being configured to support a person's upper torso and head, said sun bathing chair having an upper surface, a first lateral edge and a second lateral edge;

a pair of supports, each of said supports having a bottom end and an upper end, said supports being vertically oriented;

a pair of bases, each of said bottom ends having one of said bases attached thereto, said bases retaining said supports in a vertical orientation, each of said bases being comprised of a resiliently compressible material;

a pair of mounts, each of said supports having one of said mounts positioned thereon, said mounts being movable between associated ones of said upper and lower ends, each of said mounts being releasably securable to an associated one of said supports to secure said mounts at a selected position on said supports, each of said mounts including:

a sleeve slidably positioned on one of said supports such that said support extends through said sleeve;

a saddle being attached to said sleeve;

an elongated rod extending between and being mounted on said mounts, said rod being positioned over said upper surface to block sun over a portion of said sun bathing chair, said rod having a pair of terminal ends each extending through said saddle on an associated one of said mounts, a central portion of said rod being defined extending between said mounts, said central portion having a covering positioned thereon, said covering comprising a resiliently compressible material, an outer surface of said covering having a greatest diameter being less than 6.0 inches;

a cup holder being removably attached to one of said supports; and a housing being removably attached to one of said supports.

* * * * *